US005419651A

United States Patent [19]

Fei

[11] Patent Number: 5,419,651

[45] Date of Patent: May 30, 1995

[54] HIGHWAY PAVEMENT MARKER

[76] Inventor: Richard C. Fei, 841 N. Pioneer Ave., Wilmington, Calif. 90744

[21] Appl. No.: 251,757

[22] Filed: May 31, 1994

[51] Int. Cl.[6] ..... E01F 9/06

[52] U.S. Cl. ..... 404/14; 404/16

[58] Field of Search ..... 404/12, 13, 14, 16, 404/9

[56] References Cited

U.S. PATENT DOCUMENTS

| | | | |
|---|---|---|---|
| 4,815,890 | 3/1989 | Duncan | 404/16 X |
| 4,875,798 | 10/1989 | May | 404/14 X |
| 5,226,745 | 7/1993 | Gartlacher | 404/14 |

*Primary Examiner*—William P. Neuder
*Attorney, Agent, or Firm*—Howard A. Kenyon

[57] ABSTRACT

A pavement road marker for engagement with an underlying roadway surface for providing a marking being visible from an oncoming vehicle on the roadway surface is described.

A high strength, impact resistant plastic body with a front, a back and two sides is utilized having at least one aperture from the exterior to the interior of the body where a solid curved glass member is positioned. The glass member which has reflective material attached hereon provides a retroreflective lens that is permanently secured and hermetically sealed in the plastic body by a potting compound. The road marker is then aligned and attached to the roadway surface with an epoxy cement.

44 Claims, 4 Drawing Sheets

HIGHWAY PAVEMENT MARKER

BACKGROUND OF THE INVENTION

1. Field of the Invention

This invention relates generally to a pavement marker for engagement with an underlying roadway surface and more specifically to a pavement marker that uses a curved solid glass member with reflective material attached thereto as a retroreflective lens.

2. Description of the Prior Act

There have been many road markers suggested and patented. Road markers come in all different shapes and some use coloring to indicate a specific direction. For example, some road markers reflect white if a vehicle is going in the right direction and reflect red if the vehicle is going in the wrong direction against traffic. Roadway lane markers indicate a traffic lane for a driver at night time and are more desirable than painted lines, especially in fog or rain, and they are exceptionally helpful in the light glare of oncoming vehicles.

U.S. Pat. No. 3,332,327 discloses a pavement marker having a lens of synthetic resin in which the front face is inclined at a predetermined angle. U.S. Pat. No. 4,232,979 and U.S. Pat. No. 4,340,319 improve on U.S. Pat. No. 3,332,327 in that a thin layer of glass is applied over the synthetic resin to improve the abrasion resistant properties. U.S. Pat. No. 4,930,870 uses a transparent plastic material and various reflecting means. U.S. Pat. No. 4,717,281 uses a circular body with lens elements made from a polycarbonate. The lens in U.S. Pat. No. 4,717,281 is at a constant angle to the roadway surface but is curved in a circular configuration. U.S. Pat. No. 4,653,959 is a circular roadway marker that reflects light in a 360 degree pattern and also uses a reflective tape around the edge of the circular marker.

All of the above have one common fault, and that is low abrasion resistance of synthetic resin. U.S. Pat. No. 4,232,979 and U.S. Pat. No. 4,340,319 attempt to improve the abrasion resistance by placing a thin layer of glass over the synthetic resin, however, this thin layer tends to break and sharer and the synthetic resin therefore has no protection.

What is needed is a road marker that has high abrasion resistance and will not break and shatter with use.

HIGHWAY PAVEMENT MARKER

SUMMARY OF THE INVENTION

It is the object of the invention to provide a retroreflective road marker visible from an on coming vehicle.

It is another object of the invention to provide a road marker that has a high resistance to abrasion.

It is yet another object of the invention to provide a retroreflective lens that has a magnification of at least 25 percent.

Briefly, in accordance with the present invention, there is provided a pavement road marker which has a curved lens made from solid glass for engagement with an underlying roadway surface for providing a reflective marking for oncoming vehicles.

Other objects and advantages will become apparent from the following description and appended claims taken in conjunction with the accompanying drawings.

HIGHWAY PAVEMENT MARKER

The novel features which are believed to be characteristic of the invention as to the system together with further objects and advantages thereof, will be better understood from the following description in connection with the accompanying drawings in which the presently preferred embodiments of the invention are illustrated by way of example. It is expressly understood, however, that the drawings are for purposes of illustration and description only, and are not intended as a definition of the limits of the invention.

HIGHWAY PAVEMENT MARKER

DETAILED DESCRIPTION OF THE PREFERRED EMBODIMENTS

Figure 1:
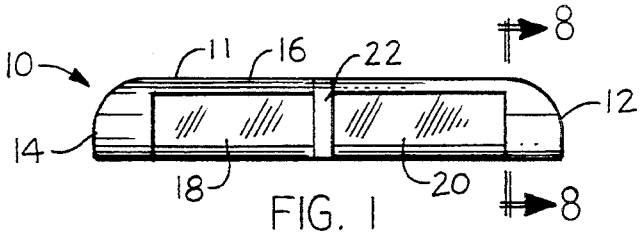
FIG. 1 is a front elevation view of a pavement marker showing curved sides.

Turning now to FIG. 1, there is seen the front elevation of a pavement marker 10 formed into a high strength, impact resistant plastic body member 11 having curved side walls 12 and 14, said pavement marker 10 also having a flat top wall 16. This view also shows retroreflective glass lenses 18 and 20 and center web member 22.

Figure 2:
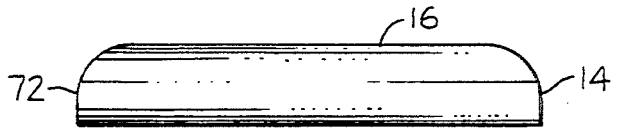
FIG. 2 is a rear elevation thereof showing curved sides.

FIG. 2 shows the rear elevation view of pavement marker 10 showing curved side walls 12 and 12. Flat top wall 16 can also be seen in this view.

Figure 3:
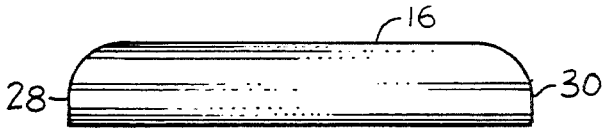
FIG. 3 is a right side elevation view showing a curved front and back, the left side being a mirror image.

FIG. 3 shows a right side elevation with curved front wall 28 and curved rear wall 30. The left side elevation being a mirror image. Again, flat top wall 16 can be seen in this view.

Figure 4:
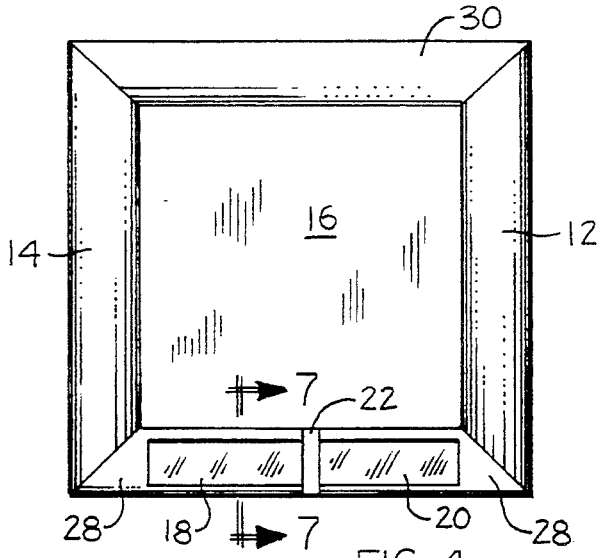
FIG. 4 is a top view of a pavement marker showing a front retroreflective lens

Turning now to FIG. 4 there is seen a top view of pavement marker 10. In this view curved retroreflective glass lenses 18 and 20 can be seen along with center web member 22. Retroreflective glass lenses 18 and 20 are formed from a one quarter round of a circular glass rod having a flat bottom and a flat back. Right side curved wall 12, left side curved wall 14, rear curved wall 30 and front wall 28 can be seen in this view.

Figure 5:
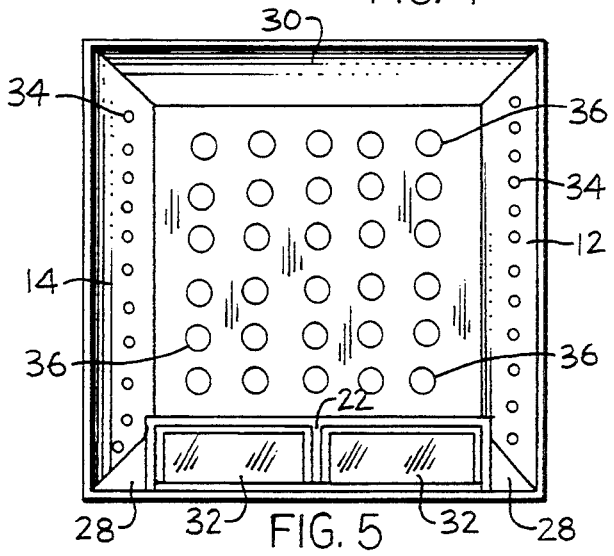
FIG. 5 is a bottom view of a pavement marker showing a front retroreflective lens and interlock members.

FIG. 5 shows the open interior cavity that forms the base of the pavement marker 10. In this view the underside of curved side walls 12 and 14 can be seen, and the underside of curved front walls 28 and curved back wait 30 can also be seen. Also seen in FIG. 5 is the retroreflective lens flat bottom cover plate 32 which covers the flat bottom portion of retroreflective glass lenses 18 and 20. In this view interlocking members 34 and 36 are also seen. The interlocking members 34 and 36 which can be in the shape of pegs or indentions assist in holding the potting compound in the pavement marker 10 since the underside of pavement marker 10 is a hollow cavity.

Figure 6:
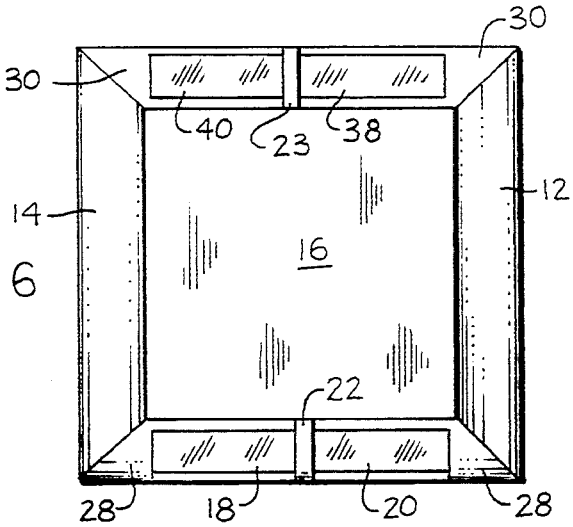
FIG. 6 is a top view showing front and rear retroreflective lenses.

Turning now to FIG. 6 there is seen a top view of another embodiment of pavement marker 10 which has a retroreflective lens in the front curved wall 28 and the rear curved wall 30. The solid glass lenses in the curved wall 30 which are identified as 38 and 40 are identical to the glass lenses in the front wall 28 which are identified as 18 and 20. There is seen flat top wall 16, curved side walls 12 and 14 also in this view. The solid glass lenses 18 and 20 could be colored white by white reflective tape, since they would be facing oncoming traffic and the solid glass lenses 38 and 40 could be colored red, by red reflective tape, since they would be facing traffic going in the wrong direction. Center web members 22 and 23 can also be seen in this view.

Figure 7:
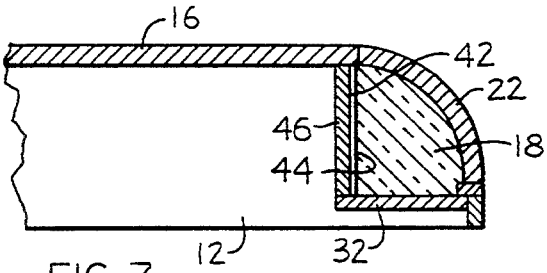
FIG. 7 is a partial sectional view of the retroreflective lens as shown in FIG. 4 showing a curved lens.

FIG. 7 shows a partial sectional view of the retroreflective solid glass lens 18 as shown in FIG. 4. As can be seen, glass lens 18 is solid and is made from a one quarter round curved glass rod. A cross section of the bottom plate 32 and the web 22 can also be seen in this view. This view also shows a cross section of the polymer reflective tape 42 having glass beads 44 attached thereto with the glass beads 44 facing the flat back portion of the curved sold glass lens 18. The polymer reflective tape 42 is attached to the back of the curved solid glass lens 18 with a flexible clear adhesive (not shown). The flexible clear adhesive is used to account for the different coefficient of expansions between the curved solid glass lens 18 and the polymer tape 42. This allows the polymer tape 42 to be hermetically sealed to the solid glass lens 18. This view also shows a backing member 46 that holds the polymer tape 42 tightly against curved solid glass lens 18. Backing member 46 and bottom plate 32 that holds curved solid glass lens 18 in place is by ultrasonic welding to body member 11.

Figure 8:
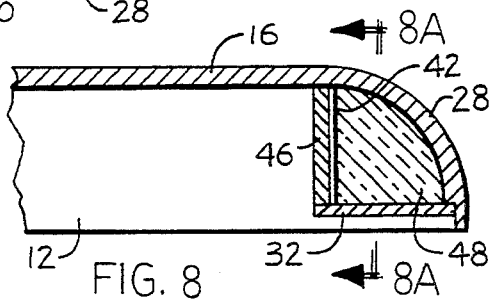
FIG. 8 is a partial sectional view of the retroreflective lens as shown in FIG. 1 showing a curved front.

Turning now to FIG. 8 there is seen a partial section view taken at the end of the retroreflective solid glass lens as shown in FIG. 1. The end of the curved solid glass lens 20 is flat which holds true for all ends of the solid glass lenses. The flat portion of solid glass lens 20 abuts a web member 48 which is formed in the body member 11. A web member (now shown) is also formed and abuts the flat end portion of solid glass lens 18. Also seen in this view is the bottom plate 32 and backing member 46 which were ultrasonically welded to body member 11 and holds curved solid glass lens 18 in place.

Figure 8A:
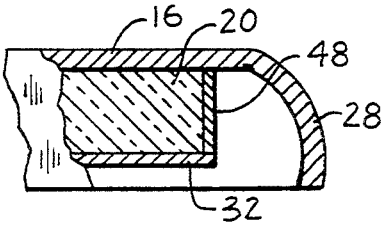
FIG. 8A shows a partial sectional view of FIG. 8 showing a curved side.

FIG. 8A is a partial cross section view of FIG. 8 which shows a cross section of web member 48. Also seen in this view is a cross section of bottom plate 32.

Figure 9:
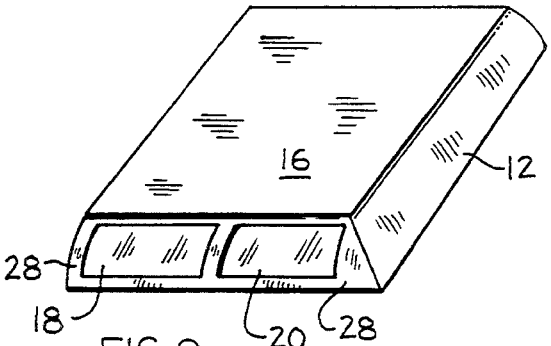
FIG. 9 is a perspective view of a pavement marker showing curved body members.

FIG. 9 gives a perspective view of the pavement marker 10 showing the fight curved side wall 12, the flat top wall 16, the curved front wall 28 and solid glass lenses 18 and 20.

Figure 10:
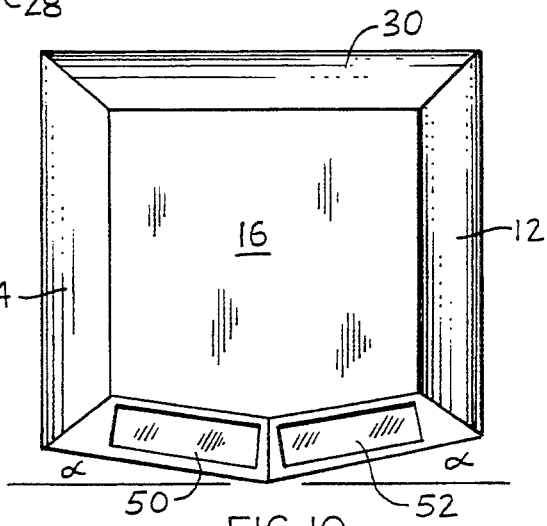
FIG. 10 is a top view of a pavement marker showing the retroreflective lenses at an angle facing oncoming vehicles.

FIG. 10 is a top view of a pavement marker which shows another embodiment that has solid glass lenses 50 and 52 set at an angle alpha ($\alpha$) to the oncoming vehicles. The angle alpha ($\alpha$) may vary from one to ten degrees. The pavement marker in FIG. 10 is otherwise identical to that shown in FIGS. 1 through 5.

Figure 11:
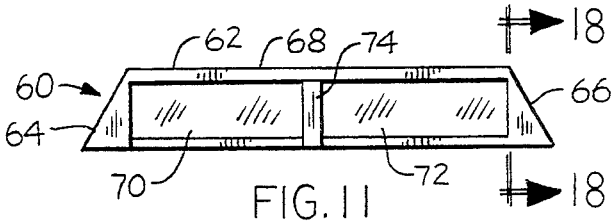
FIG. 11 is a front elevation view of a pavement marker showing planar sloping sides.

FIG. 11 shows a front elevation of a pavement marker 60 formed into a high strength, impact resistant plastic body member 62 having planar sloping side walls 64 and 66, said pavement marker 60 also having a flat top wall 68. This view also shows retroreflective solid glass lenses 70 and 72 and center web member 74.

Figure 12:
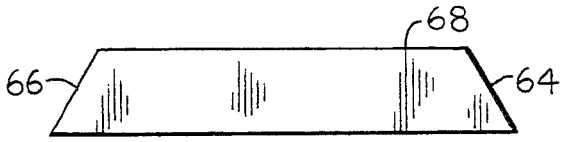
FIG. 12 is a rear elevation thereof showing planar sloping sides.

FIG. 12 shows the rear elevation view of pavement marker 60 showing planar sloping side walls 64 and 66. Flat top wall 68 can also be seen in this view.

Figure 13:
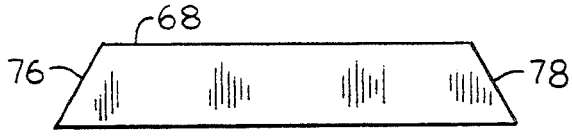
FIG. 13 is a right side elevation of a pavement marker showing a planar sloping front and back.

FIG. 13 shows a right side elevation with front planar sloping wall 76 and rear planar sloping wall 78. The left side elevation being a mirror image. Again, flat wall 68 can also be seen in this view.

Figure 14:
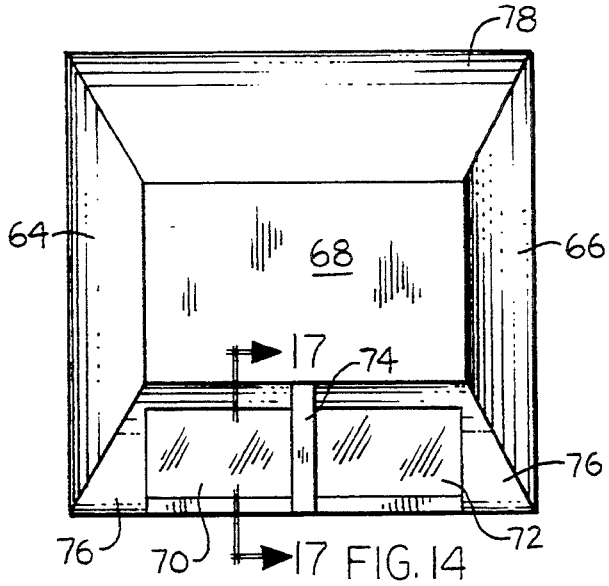
FIG. 14 is a top view of a pavement marker showing a from retroreflective lens.

FIG. 14 provides a top view of pavement marker 60. In this view retroreflective solid glass lenses 70 and 72 can be seen along with center web 74. Retroreflective solid glass lenses 70 and 72 are formed from cast quartz glass where the casting has a flat bottom and a flat back. Right side planar sloping wall 66, left side planar sloping wall 64, rear planar sloping wall 78 and front planar sloping wall 76 can be seen in this view.

Figure 15:
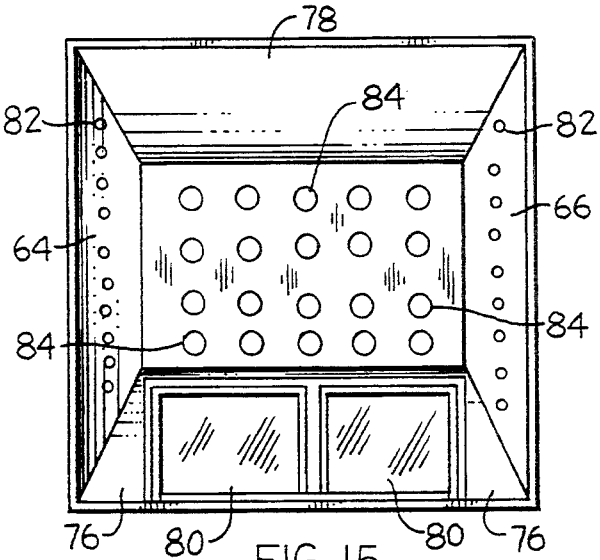
FIG. 15 is a bottom view of a pavement marker showing a front retroreflective lens and interlock members.

FIG. 15 shows the open interior cavity that forms the base of the pavement marker 60. In this view, the underside of the planar sloping walls 64 and 66 can be seen and the underside of planar sloping wall 76 and planar sloping back wall 78 can also be seen. Also seen is the retroreflective lens flat bottom cover plate 80 which covers the flat portion of solid retroreflective glass lenses 70 and 72. In this view, interlocking members 82 and 84 can also be seen. The interlocking members 82 and 84 which can be in the shape of pegs or indentations assist in holding the potting compound in the pavement marker 60 since the underside of pavement marker 60 is hollow.

Figure 16:
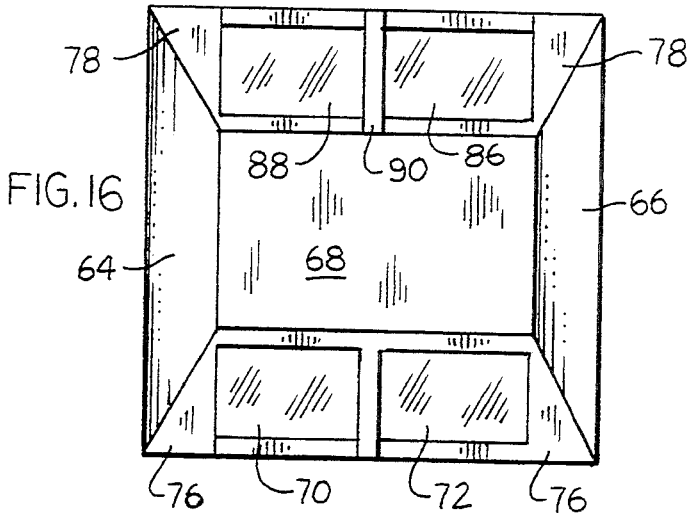
FIG. 16 is a top view showing front and rear retroreflective lenses.

Turning now to FIG. 16 there is seen a top view of another embodiment of pavement marker 60 which has a retroreflective solid glass lens in the front planar sloping wall 76 and the rear planar sloping wall 78. The solid glass lenses in the planar sloping wall 78 which are identified as 86 and 88 are identical to the solid glass lenses in the front planar sloping wall 76 which are identified as 70 and 72. There is also seen flat top wall 68, and planar sloping walls 64 and 66 in this view. The solid glass lenses 70 and 72 could be colored white by white reflective tape since they would be facing oncoming traffic and the solid glass lenses 86 and 88 could be colored red by red reflective tape since they would be facing traffic going in the wrong direction. Center web members 74 and 90 can also be seen in this view.

Figure 17:
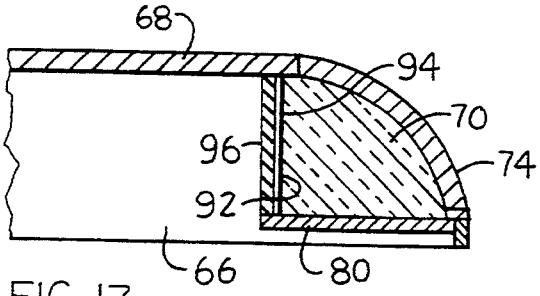
FIG. 17 is a partial sectional view, as shown in FIG. 14.

FIG. 17 shows a partial sectional view of the retroreflective solid glass lens 70 as shown in FIG. 14. As can be seen, glass lens 70 is solid and is made from a cast quartz glass. A cross section of the bottom plate 80 and web 74 can also be seen in this view. This view also shows a cross section of the polymer reflective tape 92 having glass beads 94 attached thereto with the glass beads facing the flat back portion of the solid curved glass lens 70. The polymer reflective tape 92 is attached to the back of the curved solid glass lens 70 with a flexible clear adhesive (not shown). The flexible clear adhesive is used to account for the different coefficient of expansion between the curved solid glass lens 70 and the polymer tape 94. This allows the polymer tape to be hermetically sealed to the glass lens 70. This view also shows a backing member 96 that holds the polymer tape tightly against the curved solid glass lens 70. Back member 96 and bottom plate 80 that hold curved solid glass lens 70 in place is by ultrasonic welding to body member 62.

Figure 18:
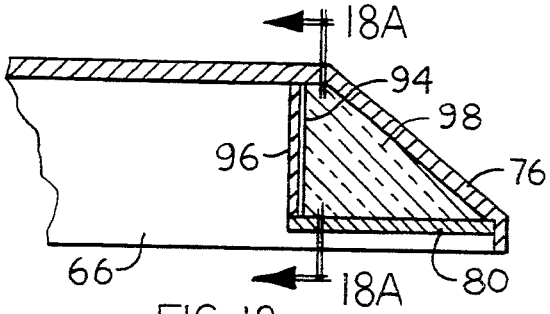
FIG. 18 is a partial sectional view of a retroreflective lens, as shown in FIG. 11.

FIG. 18 shows a partial section view taken at the end of the retroreflective sold glass lens 72 as shown in FIG. 11. The end of the curved solid glass lens 72 is flat which holds true for all ends of the solid glass lenses. The flat portion of solid glass lens 72 abuts a web member 98 which is formed in the body member 62. A web member (not shown) is also formed and abuts the flat end portion of solid glass lens 70. Also seen in this view is the bottom plate 80 and backing member 96 which are ultrasonically welded to body member 62 and holds the solid curved glass lens 70 in place.

Figure 18A:
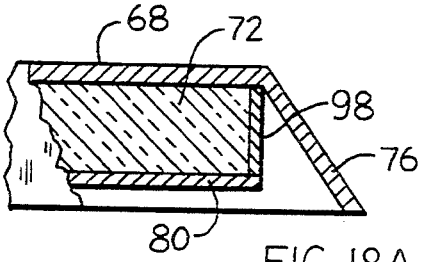
FIG. 18A is a partial sectional view of FIG. 8 showing planar sloping sides.

FIG. 18A is a partial cross section view of FIG. 18 which shows a cross section of web member 90. Also seen in this view is a cross section of bottom plate 80.

Figure 19:
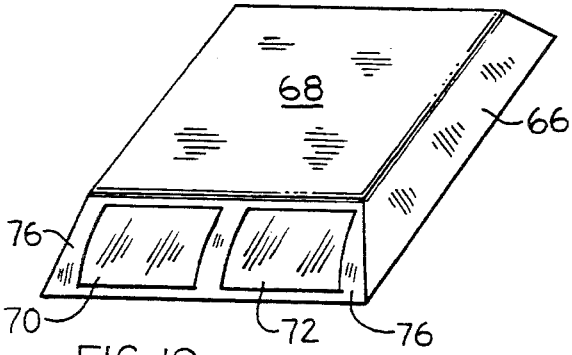
FIG. 19 is a perspective view of a pavement marker showing planar sloping body members.

FIG. 19 gives a perspective view of the pavement marker 60 showing the right planar sloping wall 66, the flat top wall 68, the planar sloping front wall 76 and solid glass lenses 70 and 72.

Figure 20:
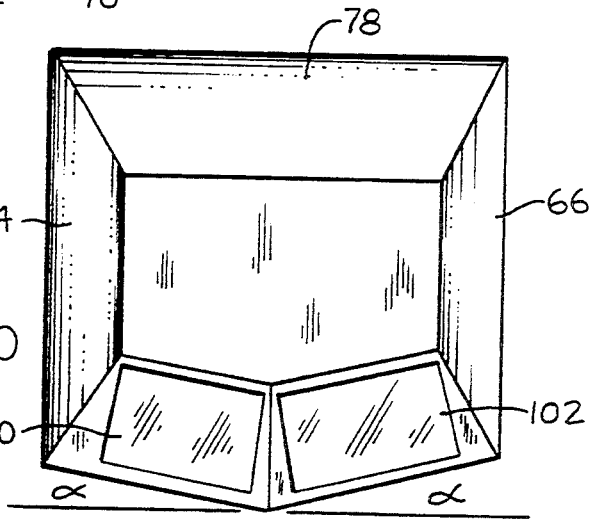
FIG. 20 is a top view of a pavement marker showing the retroreflective lenses at an angle facing oncoming traffic.

FIG. 20 is a top view of a pavement marker which shows another embodiment that has the glass lenses 100 and 102 set at an angle alpha ($\alpha$) to the oncoming traffic. The angle alpha ($\alpha$) may very from one to ten degrees. The pavement marker in FIG. 20 is otherwise identical to that shown in FIGS. 11 through 15.

It should be noted that while the preferred embodiments retroreflective material is glass beads, the reflective material may also be made from plastic prisms attached to the polymer tape.

The high strength, high impact body member 11 may be selected from a plastic material such as Acrylonitrile Butadeine Styrene (commonly known as ABS) or any number of equivalents. The reflective tape can be purchased from 3M, Avery, Sebulite, Reflectitc and others. The glass rod material is a white clear soda lime tempered and quenched glass which has high abrasion resistance and a refraction index of 1.5.

The solid glass casting is made from glass quartz material which provides superior abrasive resistance.

After the glass lenses 18 and 20 or 70 and 72 are ultrasonically welded in place in the front portion of the body members 11 and 68, a suitable potting compound is poured into the open cavity which forms the base in all embodiments. This potting compound is allowed to harden which produces a secure hermetic seal for the pavement markers 10 and 60. The finished pavement markers 10 and 60 and then aligned with the solid glass lenses 18 and 20 or 70 and 72 facing the oncoming traffic. The pavement markers 10 and 60 are then attached to the pavement with a suitable epoxy cement. The curvature of the lens as seen in FIG. 17 is the same as that provided by a three inch diameter circle. In the embodiment as shown in FIG. 13 good results in maintaining optical effectiveness and in achieving adequate wiping action have been obtained with an angle of 32 degrees with a horizontal plane of the front planar sloping wall. However, this angle may very from 20 degrees to 40 degrees. In FIG. 12, planar sloping side walls have an angle of approximately 18 degrees. This angle may also very between 10 degrees and 25 degrees. In all embodiments the device presents no hazard to passing traffic since all sides and faces are at an angle which will reduce the shock imparted to the tires of contacting vehicles.

Thus, it is apparent that there has been provided, in accordance with the invention, a highway pavement marker that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit and scope of the appended claims.

What is claimed is:

1. A pavement marker for engagement with an underlying roadway surface for providing a marking being visible from an oncoming vehicle on the roadway surface, said pavement marker comprising:

a hollow body member being substantially rigid, having a rear wall, two side walls, a fiat top wall, a front wall and an open interior cavity for a base;

at least one curved solid glass lens member, said lens member attached with fastening means inside said hollow body member, said lens member having a convex curved outer surface, flat ends, a flat bottom portion and a fiat back portion, said flat bottom portion having a cover plate and said fiat back portion being covered by a backing member;

a reflective tape permanently attached to said fiat back portion of said solid glass lens member by fastening means to form a retroreflective glass lens;

means for securing said retroreflective glass lens in said hollow body member;

means for positioning and attaching said pavement marker on said roadway surface.

2. A pavement marker as described in claim 1 wherein said curved front wall has at least one aperture extending into the interior of said hollow body member, said aperture containing at least one curved retroreflective glass lens.

3. A pavement marker as described in claim 1 wherein said curved front wall and said rear wall have at least one aperture extending into the interior of said hollow body member, said aperture containing at least one curved retroreflective glass lens.

4. A pavement marker as described in claim 1 wherein said fastening means to attach said retroreflective glass lens inside said body member is by ultrasonic welding.

5. A pavement marker as described in claim 1 wherein said reflective tape is a polymer tape that contains glass ben& for reflective material.

6. A pavement marker as described in claim 1 wherein said reflective material is plastic prisms attached to said polymer tape.

7. A pavement marker as described in claim 1 wherein said fastening means to attach said reflective tape to said back portion of said retroreflective glass lens where said glass beads or plastic prisms face said back portion of said retroreflective glass lens is by a suitable flexible adhesive.

8. A pavement marker as described in claim 1 wherein said hollow body member is made from a high strength, impact resistant plastic, said body member having interlocks formed in the interior cavity.

9. A pavement marker as described in claim 1 wherein said means for securing said retroreflective glass lens inside said hollow body member is by a suitable potting compound which hermetically seals said retroreflective glass lens in said hollow body member.

10. A pavement marker as described in claim 1 wherein said solid glass lens member is made from one quarter of a circular soda lime glass rod.

11. A pavement marker as described in claim 1 wherein said retroreflective glass lens provides a power of magnification of at least 25 percent.

12. A pavement marker as described in claim 1 wherein said means to position and attach said pavement marker on said roadway surface is by aligning said retroreflective glass lens to be visible from an oncoming vehicle on the roadway surface and attaching said pavement marker to said roadway surface with a suitable epoxy cement.

13. A pavement marker for engagement with an underlying roadway surface for providing a marking being visible from an oncoming vehicle on the roadway surface, said pavement marker comprising:

a hollow shell-like body member being substantially rigid having a curved rear wall, two curved side walls, a fiat top wall, a curved front wall, a web plate at each end of said, curved front wall a web member in the center of said curved front wall said curved front wall having at least one aperture extending into the interior of said hollow shell-like body member and said hollow shell-like body member having an open interior cavity for a base;

at least one curved solid glass lens member, said lens member being held in place with fastening means inside said cur,red front wall of said body member and secured inside said body member with securing means, said lens member further comprising one quarter of a circular soda lime glass rod having a convex curved outer surface, said soda lime glass rod having flat ends, a flat back portion and a flat bottom portion, said fiat bottom portion having a cover plate coveting said bottom portion and said flat back portion being covered by a backing member;

a reflective polymer tape containing glass beads for reflective material permanently attached by a flexible adhesive to said flat back portion of said soda lime glass rod, the combination forming a retroreflective glass lens, whereby the glass beads thee said flat back portion of said soda lime glass rod, said reflective polymer tape also having a backing member completely across said reflective polymer tape, said flat ends of said flat soda time glass rod abutting said web member in the center of said curved front wall and said flat ends also abutting said web plate at each end of said curved front wall.

14. A pavement marker as described in claim 13 wherein said reflective material is plastic prisms attached to said polymer tape.

15. A pavement marker as described in claim 13 wherein said curved front wall and said curved rear wall has at least one aperture extending into the interior of said hollow shell-like body member, said aperture containing at least one curved retroreflective glass lens.

16. A pavement marker as described in claim 13 wherein said fastening means of said retroreflective glass lens inside said curved front wall of said body member is by ultrasonic welding said cover plate on said bottom portion of said retroreflective glass lens to said hollow shell-like body member and ultrasonic welding said backing member on said back of said reflective polymer tape to said hollow shell-like body member.

17. A pavement marker as described in claim 13 wherein said hollow shell-like body member is made from a high strength, impact resistant plastic, said body member having interlocks on the interior cavity.

18. A pavement marker as described in claim 13 wherein said means for securing said retroreflective glass lens inside said hollow shell-like body member is by a potting compound which hermetically seals said retroreflective glass lens in said hollow shell-like body member.

19. A pavement marker as described in claim 13 wherein said retroreflective glass lens provides a power of magnification of at least 25 percent.

20. A pavement marker as described in claim 13 wherein said means to position and attach said pavement marker on said roadway surface is by aligning said retroreflective glass lens to be visible from an oncoming vehicle on the roadway surface and attaching said pavement marker to said roadway surface by a suitable epoxy cement.

21. A pavement marker as described in claim 13 wherein said retroreflective glass lens is divided into a right and left retroreflective glass lens, said right and left retroreflective glass lenses are off set at an angle ranging from 1 to 10 degrees from the curved from wall toward the curved rear wall.

22. A method of installing a pavement marker for providing a marking visible from an oncoming vehicle on the roadway surface, said method comprising:

providing a hollow body member being substantially rigid having a curved rear wall, two curved side walls, a flat top wall, a curved front wall and an open interior cavity for a base;

providing at least one lens member;

providing at least one quarter of a circular some lime glass rod having a convex curved outer surface, flat ends, a fiat back portion and a flat bottom portion for forming at least one glass lens member;

attaching said lens member inside said curved front wall by ultrasonic welding;

providing a polymer tape having glass beads for reflective material;

attaching said polymer tape to the flat back portion of said soda lime glass rod with a flexible adhesive, said glass beads facing the flat back portion of said soda lime glass rod, said polymer tape having glass beads adhesively attached to said back portion of said soda lime glass rod forming a retroreflective glass lens;

securing said retroreflective glass lens in said body member with a suitable potting compound which hermetically seals said retroreflective glass lens in said body member;

aligning said retroreflective glass lens in said pavement marker on said roadway surface such that said pavement marker will be visible to an oncoming vehicle on the roadway surface;

attaching said pavement marker to said roadway surface with a suitable epoxy cement.

23. A method of installing a pavement marker as described in claim 22 wherein said reflective material is plastic prisms attached to said polymer tape.

24. A method of installing a pavement marker as described in claim 22 wherein said hollow shell-like body member is made from high strength, impact resistant plastic having interlock members in the interior cavity.

25. A method of installing a pavement marker as described in claim 22 wherein said retroreflective glass lens provides a power of magnification of at least 25 percent.

26. A pavement marker for engagement with an underlying roadway surface for providing a marking being visible from an oncoming vehicle on the roadway surface, said pavement marking comprising:

a hollow rectangular body member being substantially rigid having a planar sloping rear wall two planar sloping side walls, a flat top wall, a planar sloping from wall having at least one aperture extending into the interior of said hollow shell-like body member and said hollow shell-like body member having an open interior cavity for a base;

at least one solid glass lens member, said lens member being held in place with fastening means inside said planar sloping wall of said body member and secured inside body member with scouring means, said lens member further comprising a solid glass casting said glass casting having flat ends, a flat back portion and a flat bottom portion, said flat bottom portion having a cover plate covering said bottom portion and said flat back portion being covered by a backing member;

a reflective tape permanently attached to said flat back portion of said glass casting by fastening means to form a retroreflective glass lens;

means for securing said retroreflective glass lens in said hollow body member;

means for positioning and attaching said pavement marker on said roadway surface.

27. A pavement marker as described in claim 26 wherein said aperture extending into the interior of said hollow shell-like body member contains at least one curved retroreflective glass lens.

28. A pavement marker as described in claim 26 wherein said front wall and said rear wall have at least one aperture extending into the interior of said hollow body member, said aperture containing at least one curved retroreflective glass lens.

29. A pavement marker as described in claim 26 wherein said fastening means to attached said curved retroreflective glass lens inside said body member is by ultrasonic welding.

30. A pavement marker as described in claim 26 wherein said reflective tape is a polymer tape that contains glass beads for reflective material.

31. A pavement marker as described in claim 26 wherein said reflective material is plastic prisms attached to said polymer tape.

32. A pavement marker as described in claim 26 wherein said fastening means to attach said reflective tape to said back portion of said glass lens where said glass beads or glass prisms face said back portion of said glass lens is by a suitable flexible adhesive.

33. A pavement marker as described in claim 26 wherein said hollow body member is made from a high strength, impact resistant plastic, said body member having interlocks formed in the interior cavity.

34. A pavement marker as described in claim 26 wherein said means for securing said retroreflective glass lens inside said hollow body member is by a suitable potting compound which hermetically seals said retroreflective glass lens in said hollow body member.

35. A pavement marker as described in claim 26 wherein said retroreflective glass lens provides a power of magnification of at least 25 percent.

36. A pavement marker as described in claim 26 wherein said solid glass lens member is made by casting quartz glass material, said lens member having a curved front face.

37. A pavement marker as described in claim 26 wherein said means to position and attach said pavement marker on said roadway surface is by aligning said retroreflective glass lens to be visible from an oncoming vehicle on the roadway surface and attaching said pavement marker to said roadway surface by a suitable epoxy cement.

38. A pavement marker as described in claim 26 wherein said retroreflective glass lens is divided into a fight and left retroreflective glass lenses, said right and left retroreflective glass lenses are off set at an angle ranging from one to ten degrees from the planar sloping front wall to a horizontal plane.

39. The pavement marker as described in claim 26 wherein said two planar sloping side walls have an acute angle with a horizontal plane ranging from 20 to 25 degrees.

40. A pavement marker as described in claim 26 wherein said planer sloping rear wall and said planer sloping front wall have an acute angle with a horizontal plane ranging from 20 to 40 degrees.

41. A method installing a pavement marker for providing a marking visible from an oncoming vehicle on the roadway surface, said method comprising:

providing a hollow body being substantially rigid having a planar sloping rear wall, two planar sloping side wall, a flat top wall, a planar sloping front wall and an open interior cavity for a base;

providing at least one solid glass lens member comprising of a quartz glass casting having a curved front face, said solid glass lens member also having flat ends, a flat back portion and a flat bottom portion;

attaching said lens member inside said planar sloping front wall by ultrasonic welding;

providing a polymer tape having glass beads or reflective material;

attaching said polymer tape to the flat back portion of said quartz glass casting said polymer tape having glass beads adhesively attached to said back portion of said quartz glass casting forming a retroreflective glass lens.

securing said retroreflective glass lens in said body member with a suitable potting compound which hermetically seals said retroreflective glass lens in said body member;

aligning said retroreflective glass lens in said pavement marker on said roadway surface such that said pavement marker will be visible to an oncoming vehicle on the roadway surface;

attaching said pavement marker to said roadway surface with a suitable epoxy cement.

42. A method of installing a pavement marker as described in claim 41 wherein said reflective material is plastic prisms attached to said polymer tape.

43. A method of installing a pavement marker as described in claim 41 wherein said hollow shell-like body member is made from high strength, impact resistant plastic having interlock member in the interior cavity.

44. A method of installing a pavement marker as described in claim 41 wherein said retroreflective glass lens provides a power of magnification of at least 25 percent.

* * * * *